United States Patent [19]

Kawamura

[11] 4,086,838

[45] May 2, 1978

[54] VIBRATO SIGNAL GENERATING ARRANGEMENT FOR AN ELECTRONIC MUSICAL INSTRUMENT

[75] Inventor: Katsuzi Kawamura, Hamamatsu, Japan

[73] Assignee: Nippon Gakki Seizo Kabushiki Kaisha, Japan

[21] Appl. No.: 843,406

[22] Filed: Oct. 19, 1977

[30] Foreign Application Priority Data

Nov. 19, 1976 Japan ..... 51-154512[U]

[51] Int. Cl.[2] ..... G10H 1/04

[52] U.S. Cl. ..... 84/1.25; 84/1.01; 84/1.24; 84/1.26; 84/1.13

[58] Field of Search ..... 84/1.01, 1.24, 1.25, 84/1.26, 1.13; 179/1 J, 1 M; 331/178

[56] References Cited

U.S. PATENT DOCUMENTS

| | | | |
|---|---|---|---|
| 2,817,708 | 12/1957 | Fender | 179/1 J |
| 2,899,644 | 8/1959 | Leslie | 84/1.25 X |
| 3,288,909 | 11/1966 | George | 84/1.25 |
| 3,973,463 | 8/1976 | Schreier | 84/1.25 |

*Primary Examiner*—Ulysses Weldon
*Attorney, Agent, or Firm*—Flynn & Frishauf

[57] ABSTRACT

A delayed vibrato signal generating arrangement comprises an envelope signal generator having a capacitor, a switching device for discharging the capacitor at the instant of key depression, and two charging circuits providing different charging time constants for charging the capacitor to produce an envelope signal; a semiconductor unidirectional device coupled to the envelope signal generator; and a vibrato signal generator coupled to the unidirectional device. The capacitor is relatively rapidly charged to a predetermined potential level by both the two charging circuits and then gradually charged by only one of the charging circuits. The signal portion of the envelope signal substantially below the predetermined potential level is clipped off by the unidirectional device to provide a time delay for delayed vibrator. The time delay is virtually determined by the time constant for charging the capacitor to the predetermined potential level.

7 Claims, 5 Drawing Figures

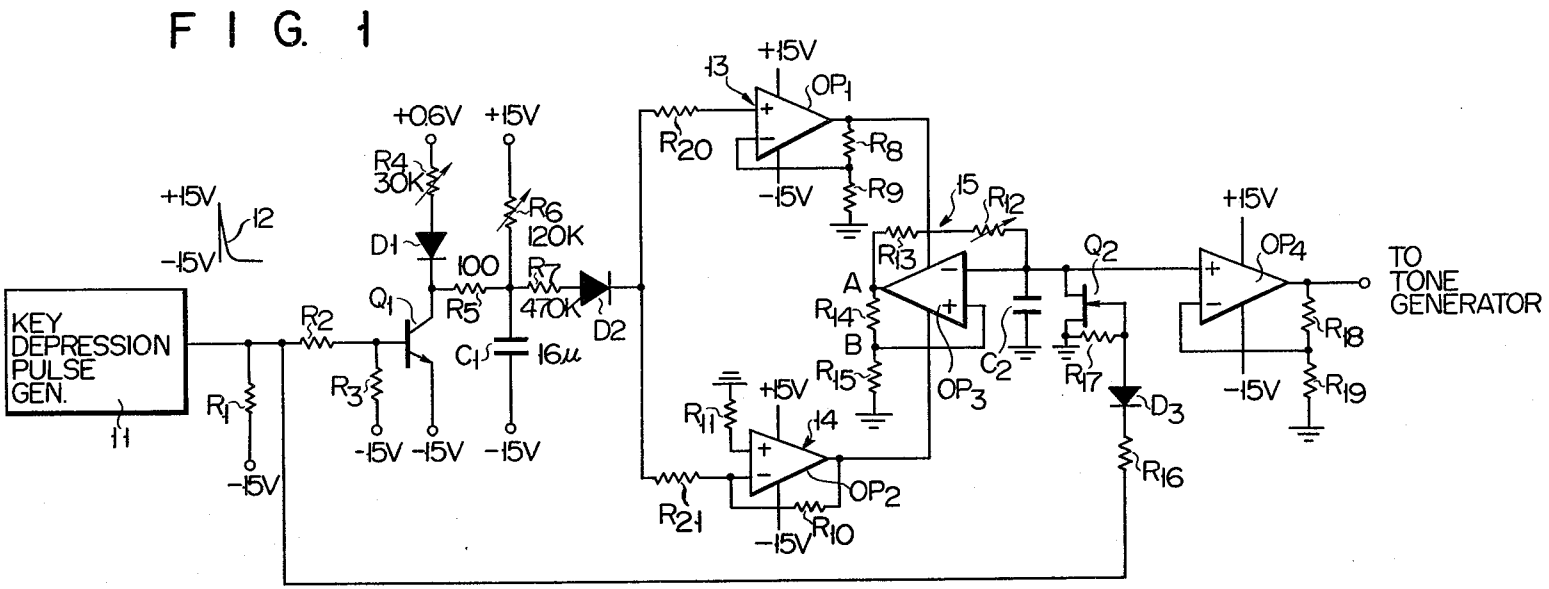
FIG. 1
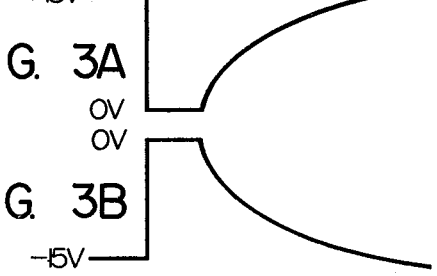
FIG. 3A
FIG. 3B
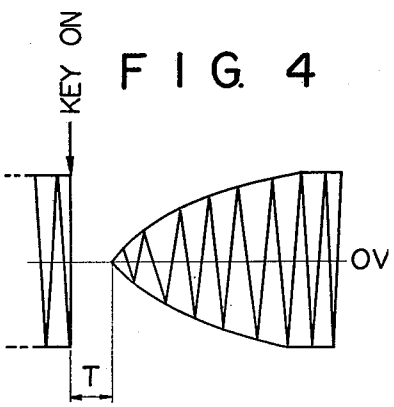
FIG. 4
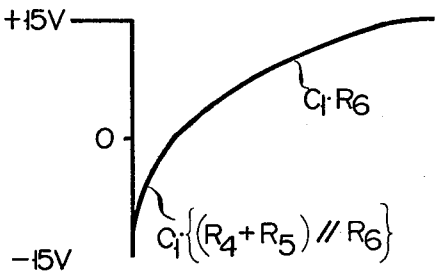
FIG. 2

VIBRATO SIGNAL GENERATING ARRANGEMENT FOR AN ELECTRONIC MUSICAL INSTRUMENT

BACKGROUND OF THE INVENTION

The present invention relates to a vibrato signal generating arrangement for an electronic musical instrument.

An electronic musical instrument is generally accompanied with a vibrato device. In the electronic musical instrument, it is more preferable to add vibrato after the lapse of a relatively short time from key depression and then increase such vibrato gradually than to add vibrato immediately after key depression. The former vibrato is known as the delayed vibrato. In such delayed vibrato, a clear tone pitch of the depressed key may be obtained at time of key depression.

A typical example of existing delayed vibrato devices is provided with a series combination of a resistor and a capacitor connected between a DC power supply and ground, an astable multivibrator for generating vibrato signals connected in parallel with the capacitor with one end connected to ground, a one-shot multivibrator triggered by a trigger pulse obtained at key depression to generate an output pulse with a predetermined duration, and a switch circuit connected in parallel with the capacitor and allowed to conduct by the output pulse from the one-shot multivibrator.

According to the aforesaid vibrato device, the capacitor discharges for the duration (about 10ms) of the output pulse from the one-shot multivibrator, and thus the astable multivibrator generates no vibrato signal. After extinguishment of the output pulse from the one-shot multivibrator, the capacitor charges gradually. On start of charging of the capacitor, the astable multivibrator starts to oscillate and generate an output signal with an amplitude depending on the voltage across the capacitor. Namely, the output amplitude of the astable multivibrator increases gradually.

The above-mentioned vibrato device has a somewhat complicated construction due to the provision of the one-shot multivibrator. The output amplitude of the astable multivibrator fluctuates between the supply voltage and the ground potential. Therefore, the DC level at the output of the astable multivibrator fluctuates while the output amplitude of the astable multivibrator varies. Thus, even though the astable multivibrator is coupled to a tone generator through a coupling capacitor, the average pitch of a tone generated will vary due to the fluctuation of the DC level.

Another example of delayed vibrato devices is proposed in the U.S. Patent Application Ser. No. 787,149 filed Apr. 13, 1977 and assigned to the same assignee as the present application. The vibrato signal generating arrangement proposed in the above-mentioned application comprises envelope signal generating means, a unidirectional clipping device for clipping the envelope signal, and vibrato signal generating means driven by the output of the unidirectional clipping device to generate a vibrato signal. With this arrangement, the time delay for delayed vibrato is determined virtually by the cut-in voltage of the unidirectional device or diode which varies with temperature variation. This arrangement has, therefore, a drawback that the time delay for delayed vibrato varies with temperature variation.

SUMMARY OF THE INVENTION

An object of the present invention is to provide an improved delayed vibrato signal generating arrangement for an electronic musical instrument.

Another object of this invention is to provide a delayed vibrato signal generating arrangement simple in construction for an electronic musical instrument.

Still another object of this invention is to provide a delayed vibrato signal generating arrangement capable of generating a vibrato signal free from fluctuations of DC level.

A further object of this invention is to provide a delayed vibrato signal generating arrangement in which the time delay for delayed vibrato can be kept substantially constant irrespective of temperature variation.

The vibrato signal generating arrangement according to this invention is characterized by a combination of envelope signal generating means, a unidirectional clipping device for clipping the envelope signal, and vibrato signal generating means driven by the output of the clipping unidirectional device to generate a vibrato signal.

The envelope signal generating means includes sources of first, second and third potentials, the third potential having an intermediate value between the first and second potentials; a capacitor having a first terminal connected to the source of the second potential; a switching device connected in parallel with the capacitor; a series combination of a first resistor and a unidirectional device connected between the source of the third potential and a second terminal of the capacitor; a second resistor connected between the source of the first potential and the second terminal of the capacitor; the junction between the second resistor and the capacitor being coupled to the unidirectional clipping device; and means for enabling the switching device at the instant of key depression to discharge the capacitor.

BRIEF DESCRIPTION OF THE DRAWING

FIG. 1 illustrates a vibrato signal generating arrangement according to an embodiment of this invention;

FIG. 2 is a waveform diagram of an envelope signal generated by the envelope signal generator as shown in FIG. 1;

FIGS. 3A and 3B illustrate the output waveforms of an in-phase amplifier and an inverting amplifier as shown in FIG. 1 respectively; and FIG. 4 is an output waveform diagram of the vibrato oscillator as shown in FIG. 1.

DETAILED DESCRIPTION OF THE PREFERRED EMBODIMENT

Referring now to FIG. 1, an output of a key depression representative pulse generator 11 is coupled to a −15V supply through a resistor R1 which generates, upon key depression, a trigger pulse or key depression representative pulse 12 which rises from −15V to +15V and decays from +15V to −15V. The trigger pulse 12 is coupled through a resistor R2 to the base of a switching transistor Q1. The base of transistor Q1 is connected to −15V supply through a resistor R3, while the emitter thereof is connected directly to −15V supply. The collector of transistor Q1 is coupled through a series combination of a silicon diode D1 having a threshold voltage or cut-in voltage of about +0.6V and a variable resistor R4 to a voltage cupply of about +0.6V which corresponds to the cut-in voltage of the diode D1. The collector of transistor Q1 is also connected to +15V supply through a resistor R5 and a variable resistor R6 in this order. The junction of the resistor R5 and the resistor R6 is connected to −15V supply through a capacitor C1. The resistor R6 has a large value than the resistor R4. The junction between the resistor R6 and the capacitor C1 is coupled through a resistor R7 to the anode of a silicon diode D2 acting as a clipper.

The cathode of the diode D2 is coupled through a resistor R20 to the noninverting input of an operational amplifier OP1 forming an in-phase amplifier 13 as well as through a resistor R21 to the inverting input of an operational amplifier OP2 forming an inverting amplifier 14. The output of the operational amplifier OP1 is connected to ground through resistors R8 and R9, while the junction between both these resistors is coupled to the inverting input of the operational amplifier OP1. The output of the operational amplifier OP2 is coupled to its inverting input through a resistor R10, while its noninverting input is connected to ground through a resistor R11.

The outputs of the in-phase amplifier 13 and the inverting amplifier 14 function as positive- and negative-power supplies for a vibrato oscillator 15. The vibrato oscillator 15 is provided with an operational amplifier OP3, a capacitor C2 connected between the inverting input of the amplifier OP3 and ground, a variable resistor R12 and a resistor R13 connected in series between the inverting input and the output of the operational amplifier OP3, resistors R14 and R15 connected in series between the output of the operational amplifier OP3 and ground and having the junction therebetween connected to the noninverting input of the amplifier OP3.

An N-channel depletion-type field-effect transistor Q2 is connected in parallel with the capacitor C2. The gate of transistor Q2 is connected to the anode of a diode D3 with the cathode connected to the output of the pulse generator 11 through a resistor R16, and connected to ground through a resistor R17. The output of the vibrato oscillator 15 or the inverting input of the operational amplifier OP3 is connected to the noninverting input of an operational amplifier OP4, while the output of the amplifier OP4 is connected to ground through resistors R18 and R19 connected in series with the junction therebetween connected to the inverting input of the amplifier OP4. Further, the output of the operational amplifier OP4 is coupled to a tone generator through a vibrato selection switch not shown.

In the operation of the vibrato device as shown in FIG. 1, the capacitor C1 is charged to a level of +15V when the transistor Q1 is nonconducting. When the trigger pulse 12 is applied to the base of transistor Q1 at the instant of key depression, the transistor Q1 conducts. Consequently, the capacitor C1 is discharged rapidly to the −15V potential level through the resistor R5 and the transistor Q1. When the trigger pulse 12 disappears, the transistor Q1 is rendered nonconducting. As a result, the capacitor C1 is charged by +0.6V supply through a charging path having the resistor R4, diode D1 and resistor R5, and by +15V supply through another charging path having the resistor R6. In this case, the potential at the junction of capacitor C1 and resistor R6 rises relatively rapidly at the time constant of C1 ·{(R4+R5)//R6} from the −15V level to the zero or ground potential level which is equal to difference between +0.6V supply voltage and the threshold voltage or cut-in voltage of the diode D1. Thereafter, the capacitor C1 is gradually charged only by +15V supply through the charging path having the resistor R6 from the ground potential level to the +15V level at the time constant of C1·R6. From the junction of the resistor R6 and capacitor C1 an envelope signal as shown in FIG. 2 is obtained. The variable resistors R4 and R6 may be adjusted to alter the charging time constants.

A portion of the envelope signal below a potential level of +0.6V, is clipped off by the silicon diode D2 with a threshold voltage or cut-in voltage of about +0.6V. In the clipper as shown in FIG. 1, the clipped level at the output of the clipper D2 corresponds to the ground potential level.

From the in-phase amplifier 13 and the inverting amplifier 14 connected to the clipper D2 and having the same voltage gain, there are obtained output waveforms which have the ground potential level and are symmetrical with respect to such ground potential level as shown in FIGS. 3A and 3B. The vibrato oscillator 15 is powered from the output voltages of the in-phase and inverting amplifiers 13 and 14 to perform oscillating operation. During the oscillating operation, the capacitor C2 is alternately subjected to repeated charge and discharge, and the level of the capacitor C2 voltage or oscillator output voltage is in proportion to the difference between the output voltages of the in-phase and inverting amplifiers 13 and 14.

There will be given a detailed description of the operation of the vibrato oscillator 15. Under the normal condition, the diode D3 is conducting, so that the gate of transistor Q2 is biased negative beyond the threshold voltage and thus the transistor Q2 is nonconducting. The diode D3 is rendered nonconducting by the trigger pulse 12 to bias the gate of the transistor Q2 to the ground potential, thereby allowing the transistor Q2 to conduct. Consequently, the capacitor C2 discharges through the transistor Q2 to reset the output voltage of the vibrato oscillator 15 to 0V. In this state, if the output at point A of the operational amplifier OP3 when powered is positive, the noninverting input potential or the potential at point B is also positive. As a result, since the inverting input is at the ground potential level, the output of the operational amplifier OP3 instantaneously reaches the output voltage of the in-phase amplifier 13. Thereafter, the capacitor C2 is gradually charged by the output voltage of the operational amplifier OP3 through the resistors R12 and R13. When the voltage at the capacitor C2 is equalized to the input voltage on the non-inverting input, the output at point A of the operational amplifier OP3 is switched over to the negative output voltage of the inverting amplifier 14. Thus, the capacitor C2 discharges through the resistors R12 and R13. When the potentials at the noninverting and inverting inputs of the amplifier OP3 are equalized to each other as a result of such discharging of the capacitor C2, the output at point A of the amplifier OP3 is again switched over to the positive output voltage of the in-phase amplifier 13. Thereafter, such operation is repeated, and the vibrato oscillator 15 oscillates at a frequency depending on the output voltage of the amplifier OP3, the resistor R13, variable resistor R12, and capacitor C2. The oscillating frequency of the vibrato oscillator 15 may be changed by the variable resistor R12. As shown in FIG. 4, the output of the vibrato oscillator 15 has an amplitude varying with the envelope of the output voltage of the in-phase and inverting amplifiers and a frequency increasing with the increase of the difference between the output voltages of the in-phase and inverting amplifiers. With the arrangement shown in FIG. 1, the time interval T from key depression to actuation of the vibrato oscillator 15 is determined virtually by the time constant C1·{(R4+R5)//R6} for charging the capacitor C1 from −15V level to ground potential level, and hardly affected by temperature drift of the threshold voltage or cut-in voltage of the clipping diode D2. That is, in accordance with the invention, the time delay for delayed vibrato can be kept substantially constant irrespective of temperature variation. The time interval T from key depression to actuation of the vibrato oscillator 15 may be adjusted by means of the variable resistors R4 and R6. It is to be understood that the average DC level at the output of the vibrato oscillator 15 is 0V.

The output of the vibrato oscillator 18 is coupled to the tone generator through the high input impedance buffer amplifier OP4, so that the tone signal is frequency-modulated in a conventional method to provide a vibrato effect.

What is claimed is:

1. A vibrato signal generating arrangement for an electronic musical instrument comprising:

potential sources of first, second and third potentials, said third potential having an intermediate value between said first and second potentials;

a capacitor having a first terminal connected to said source of the second potential;

a switching device connected in parallel with said capacitor;

a series combination of a first resistor and a first unidirectional device connected between said source of the third potential and a second terminal of said capacitor;

a second resistor connected between said source of the first potential and said second terminal of said capacitor;

a second unidirectional device having an input connected to the junction between said second resistor and said capacitor;

means coupled to said switching device for producing a key depression representative signal at the instant of key depression to render said switching device conductive to discharge said capacitor; and a vibrato oscillator means connected to an output of said second unidirectional device.

2. The arrangement according to claim 1 wherein said first resistor is of variable type.

3. The arrangement according to claim 1 wherein said second resistor is of variable type.

4. The arrangement according to claim 1 wherein said second resistor has a greater value than said first resistor.

5. The arrangement according to claim 1 wherein said second unidirectional device is a diode.

6. The arrangement according to claim 1 wherein the third potential has a value which substantially equals the threshold voltage of said first unidirectional device.

7. The arrangement according to claim 1 wherein said first unidirectional device is a diode.

* * * * *